US006514930B2

(12) United States Patent
Emery et al.

(10) Patent No.: US 6,514,930 B2
(45) Date of Patent: Feb. 4, 2003

(54) PRODUCTION OF ANIONIC SURFACTANT GRANULES BY IN SITU NEUTRALISATION

(75) Inventors: William Derek Emery, Wirral (GB); Andreas Theodorus Groot, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/957,326

(22) Filed: Sep. 20, 2001

(65) Prior Publication Data

US 2002/0061830 A1 May 23, 2002

(30) Foreign Application Priority Data

Sep. 25, 2000 (GB) ..... 0023487

(51) Int. Cl.[7] ..... C11D 17/00

(52) U.S. Cl. ..... 510/444; 510/445; 510/446; 510/450; 510/457

(58) Field of Search ..... 510/444, 445, 510/450, 446, 457

(56) References Cited

U.S. PATENT DOCUMENTS

| | | | | |
|---|---|---|---|---|
| 5,490,954 | A | 2/1996 | van der Hoeven et al. | 252/550 |
| 5,641,741 | A | 6/1997 | Emery et al. | 510/457 |
| 5,646,107 | A | 7/1997 | Emery et al. | 510/457 |
| 5,856,294 | A | 1/1999 | Emery | 510/456 |
| RE36,593 | E | 2/2000 | Emery | 510/456 |
| 6,140,302 | A | 10/2000 | Lueder et al. | 510/444 |
| 6,191,097 | B1 | 2/2001 | Lueder et al. | 510/444 |

FOREIGN PATENT DOCUMENTS

| | | |
|---|---|---|
| EP | 506 184 | 9/1992 |
| EP | 0 555 622 | 8/1993 |
| EP | 0 572 957 | 12/1993 |
| WO | 96/06916 | 3/1996 |
| WO | 96/06917 | 3/1996 |
| WO | 97/32002 | 9/1997 |
| WO | 98/38278 | 9/1998 |
| WO | 98/40461 | 9/1998 |
| WO | 98/54289 | 12/1998 |
| WO | 98/58046 | 12/1998 |
| WO | 00/31222 | 6/2000 |

OTHER PUBLICATIONS

GB Search Report in a GB application GB 0023488.0.
GB Search Report in a GB application GB 0023489.8.
Co–pending application: Applicant: Emery et al., S/N 08/518,931, Filed: Aug. 24, 1995.
Co–pending application: Applicant: Emery et al., S/N 09/957,227, Filed: Sep. 20, 2001.
Co–pending application: Applicant: Emery et al., S/N 09/957,228, Filed: Sep. 20, 2001.
PCT International Search Report in a PCT application PCT/EP 01/10657 Sep. 2000.
PCT International Search Report in a PCT application PCT/EP 01/10633 Sep. 2000.
PCT International Search Report in a PCT application PCT/EP 01/10655 Sep. 2000.

*Primary Examiner*—Necholus Ogden
(74) *Attorney, Agent, or Firm*—Rimma Mitelman

(57) ABSTRACT

A process for the production of detergent particles comprises feeding an acid precursor of an anionic surfactant, a neutralizing agent and aluminosilicate detergency builder into a horizontal thin-film evaporator/drier. The evaporator/drier comprises a mixing region, a drying region and a cooling region. Neutralization of the acid precursor is effected, together with granulation, drying and cooling, to form the detergent particles. At least some of the aluminosilicate builder is fed into the thin-film evaporator/drier between the drying region and the cooling region and/or into the cooling region. When all of he aluminosilicate builder is fed into the cooling region, the aluminosilicate is in an amount of more than 20% by weight of the particles exiting the cooling region.

11 Claims, No Drawings

PRODUCTION OF ANIONIC SURFACTANT GRANULES BY IN SITU NEUTRALISATION

TECHNICAL FIELD

The present invention relates to a process for the production of anionic detergent particles and detergent compositions containing them. More particularly the present invention relates to a process for the production of detergent particles having a high level of anionic surfactant which involves in situ neutralisation of an acid precursor of the anionic surfactant and drying of the surfactant thereby produced.

BACKGROUND & PRIOR ART

It is known that detergent particles having high anionic surfactant levels can be prepared by processes in which acid precursors of anionic surfactants are neutralised with a neutralising agent in horizontal thin-film evaporator/drier (WO-A-96/06916, WO-A-96/06917 & WO-A-97/32002; WO-A-98/38278 & WO-A-98/40461) and the mass is granulated and dried. As used herein, the term thin-film evaporator/drier is understood to include flash-driers and scraped-surface driers as described in WO-A-96/06916, WO-A-96/06917 & WO-A-97/32002.

Basically, a thin-film evaporator/drier comprises a cylindrical chamber in which is located a coaxial shaft on which is mounted a plurality of blade-like tools. The pitch of these tools can be set to different angles along the length of the cylindrical chamber, from input end to output end. The clearance between the tips of the blade-like tools and the internal surface of the cylindrical chamber is very small, typically 5 mm or less. The cylindrical chamber comprises at least a mixing region at or towards the input end of the cylindrical chamber, a cooling region at or towards the output end of the cylindrical chamber and a drying region between the mixing and cooling regions. The drying region typically comprises one or more heating zones and the cooling region may comprise one or more cooling zones (although usually only one cooling zone. Each of the heating and cooling zones is defined by a respective jacket around the cylindrical chamber with a respective axial gap between each and through which jackets, a heating or cooling liquid, as appropriate, is pumped during operation of the process. The layering agent is "typically an aluminosilicate or a silica. The maximum amount of the layering agent dosed into the cooling region is 25% by weight of the resultant detergent particles.

Commonly, products obtained from the aforementioned process using a thin-film evaporator/drier also contain aluminosilicate detergency builder. A problem arises that the aluminosilicate interferes with the neutralisation reaction in some way. Imperfect neutralisation of the free acid form of the anionic surfactant results in one or more of the following negatives:

(i) production of oversize particles;

(ii) softer particles which are more difficult to handle and store;

(iii) the generation of heat during storage as the neutralisation reaction continues;

(iv) increased uptake of moisture upon storage, due to the hygroscopicity of many acid precursors, resulting in poor powder flow properties both of the detergent particles and of detergent compositions containing the detergent particles.

These problems are especially prevalent when neutralising linear alkyl benzene sulphonic acid (LAS acid) precursors and alkyl sulphuric acid half-esters.

WO-A-97/32002 discloses a "dry-neutralisation" process in which high anionic surfactant-content detergent particles are manufactured by contacting a pumpable acid precursor with a solid neutralising agent, such as for example sodium carbonate, in a thin-film evaporator/drier.

EP-A-555 622 describes the manufacture of detergent particles comprising anionic surfactant in which acid precursors are neutralised in a high shear mixer by a stoichiometric excess of particulate neutralising agent, preferably sodium carbonate. The neutralisation reaction is optimised by using neutralising agent of a narrowly defined particle size range, namely 50% by volume has a particle diameter of less than 5 microns. However, this reference is not specifically concerned with problems arising from incorporation of aluminosilicate and does not relate to the production of high anionic surfactant-content detergent particles or to the use of thin-film evaporator/driers.

We have now found that one or more of the aforementioned problems can be diminished or overcome by introducing at least part of the aluminosilicate between the drying region and cooling region and/or in the cooling region.

SUMMARY OF THE INVENTION

Accordingly, this invention provides a process for the production of detergent particles, the process comprising feeding an acid precursor of an anionic surfactant, a neutralising agent and aluminosilicate detergency builder into a horizontal thin-film evaporator/drier comprising a mixing region, a drying region and a cooling region, to effect neutralisation of the acid precursor, granulation, drying and cooling, to form the said detergent particles, wherein at least some of the aluminosilicate builder is fed into the thin-film evaporator/drier between the drying region and the cooling region and/or into the cooling region, provided that when all of the aluminosilicate builder is fed into the cooling region, the aluminosilicate is in an amount of more than 20% by weight of the particles exiting the cooling region. Preferably, the aluminosilicate is in an amount of more than 25% by weight of the particles exiting the cooling region.

This invention also provides detergent particles obtainable by the process.

DETAILED DESCRIPTION OF THE INVENTION

Simultaneous Neutralisation, Drying and Granulation Process in a Thin-Film Evaporator/Drier The process is carried out in a horizontal thin-film evaporator/drier (hereinafter referred to as an "evaporator/drier"). A commercial scale machine typically comprises at least 300, preferably at least 500, more preferably at least 750, especially at least 1000 blade-like tools. The clearance between the blades and the internal wall of the chamber is suitably less than 20 mm, e.g. 15 mm or less, or even 10 mm or less. The blade tip speed in operation is suitably $\geqq 15$ $ms^{-1}$, preferably $\geqq 20$ $ms^{-1}$. The ratio of exposed blade length to shaft radius is preferably less than 1, e.g. less than 0.5. Preferably, the large number of blades and the pitch of the blades also means that at least 40%, for example at least 45%, and even substantially the whole chamber wall (that part along the length of the shaft which carries the blades) is scraped during operation.

Initial mixing of the components occurs in the mixing region and the neutralisation reaction is begun. Mixing and neutralisation then continue throughout the process, through the drying and cooling regions.

The anionic surfactant acid precursor (hereinafter referred to as the "acid precursor") and neutralising agent are normally fed into the mixing region of the evaporator/drier. However, all or part of either component can be dosed into the drying region. Neutralisation occurs to form a surfactant paste, which is then converted into detergent particles by the drying and mechanical action of the evaporator/drier. The evaporator/drier exerts its drying action by forming a thin layer of material on a heated surface within the drying region.

The acid precursor is suitably fed into the evaporator/drier in a liquid phase. As acid precursors can be unstable, the neutralisation preferably occurs sufficiently rapidly and substantially completely such that thermal decomposition of the acid due to elevated temperature is minimised and desirably avoided.

The neutralising agent is introduced into the evaporator/drier as a solid particulate material. Preferably, the amount of neutralising agent with respect to the acid precursor added to the mixing region is at least in stoichiometric equality, most preferably in excess. Preferably, at least 1.25 times required for stoichiometric neutralisation is used but preferably no more than 2 times. Higher amounts of neutralising agent, e.g. no more than 5 times, no more than 4.5 times, or no more than 4 times that required for stoichiometric neutralisation can be used but these higher amounts are generally less preferred.

The acid precursor and neutralising agent may be added as a single stream to the evaporator/drier, or as two or more streams.

The drying region of the evaporator/drier basically comprises a tube which is substantially circular in cross section and is thus defined by a cylindrical wall. The material entering the drying region is heated. Typically this is achieved by heating the wall of the drying region by means of a heating jacket through which water, steam or oil may be fed.

The drying region may be divided into a number of heating zones, each heated to the same or a different temperature, preferably by means of a respective heating jacket. The temperature in the drying region is preferably maintained at at least 100° C., more preferably at at least 120° C., yet more preferably at at least 130° C. Higher temperatures are possible, but it will be understood by the skilled person that it is preferable not to exceed the thermal decomposition temperature of the acid precursor or the anionic surfactant formed therefrom. Depending on the detergent active, temperatures up to 170° C. or even up to 180° C. are employed.

It has been found to be highly advantageous in the process of the invention to pass the material leaving the drying region of the evaporator/drier through a cooling region. The cooling region may be provided by a separate piece of apparatus, such as for example a cooling fluid bed, an airlift alternatively, may form part of the evaporator/drier apparatus.

The cooling region is preferably operated at a temperature not in excess of 50° C. and more preferably not in excess of temperature 40° C., e.g. 30° C. Actively cooling the particles reduces the possibility of thermal decomposition occurring due to particles being heated to a high temperature. In addition, actively cooling reduces the risk of particles sticking/clumping which may occur when heated particles are allowed to cool passively.

Preferably, the cooling region is defined by a cylindrical wall which is cooled, for example, by a cooling jacket. Where the process is continuous, the evaporator/drier and the cooling region are suitably arranged so that the drying region and cooling region are substantially horizontally aligned to facilitate efficient drying, cooling and transport of the material through the drying region and cooling region in a generally horizontal direction.

In a preferred embodiment, the evaporator/drier apparatus includes the cooling region positioned after the drying region, and the cooling region is a tube which is substantially circular in cross section and is thus defined by a cylindrical wall. When such evaporator/drier apparatus is employed, a suitable temperature gradient is set up going from, for example, at least 100° C. at the inlet end to, for example, not more than 80° C. at the outlet end.

Agitation of the materials in the drying region generally provides efficient heat transfer and facilitates removal of water. Agitation reduces the contact time between the materials and the wall of the drying region, which, together with efficient heat transfer, reduces the likelihood of "hot spots" forming which may lead to thermal decomposition. Moreover, improved drying is secured thus allowing a shorter residence time and increased throughput in the heating zone(s).

Preferably, the cooling region is also provided with agitation means to effect efficient cooling of the material therein. This may be a fluidising gas in a cooling fluid bed. Alternatively, where the cooling region is part of the evaporator/drier apparatus, it is preferred to use the same rotating agitation means as defined above in relation to the drying region.

It will be understood that the cooling region may comprise more than one cooling zone.

In a preferred embodiment, drying and cooling regions together comprise three zones defined by a cylindrical wall, the first two zones being heating zones defining the drying region, and the third zone being the cooling region. Acid precursor and neutralising agent are fed in to the first zone and rotating agitation means comprising a series of radially extending paddles and/or blades mounted on a axially mounted rotatable shaft agitates and transports material through the heating and cooling zones to produce detergent particles.

Preferably, the evaporator/drier is operated at atmospheric pressure in counter-current or co-current with a gas stream at a throughput rate of 10–150 $m^3$ per hour. The gas stream may simply be air, which may have been dried so as to reduce its moisture content, or may be a gas stream having an alkaline pH, such as for example a mixture of ammonia and air.

The process of the invention is preferably continuous as this facilitate continuous transportation of the particles.

Suitably the total average residence time in the drying region is from 30 seconds to 15 minutes, preferably from 1 minute to 12 minutes, more preferably from 2 minutes to 8 minutes. The average residence time may be determined by injecting a coloured tracer and plotting a concentration profile for the tracer exiting the drying region. The average residence time is taken as the value corresponding to 50% of the total area under the curve. Preferably, the measurement is repeated a suitable number of times.

Advantageously, oversize particles from the output of the process may be recycled to be input to the evaporator/drier.

Preferably, an oversize granule fraction is separated from the output particles such that at least 70 wt % of the particles in the oversize fraction have a minimum diameter of 1000 μm or more. Most preferably, at least 95 wt % have a minimum diameter of 700 μm or more. Minimum particle diameter may be considered as the smallest particles which will not pass through a sieve of a mesh which retains particles of the relevant size or larger. Preferably, the oversize fraction is fed back into the mixing and/or drying region and/or between the two.

The process of the invention may be carried out in any suitable apparatus. Suitable thin-film evaporator/drier apparatus include the "Flash Dryer/Reactor" manufactured by VRV, the "Turbodryer" manufactured by VOMM and a similar machine available from Bipex Hosokawa.

Acid Precursors

Prior to neutralisation and drying, the anionic surfactants are present and fed into the drying region of the evaporator/drier in their acid precursor form. The acid precursor can either be fed as an aqueous preparation or in anhydrous form. If added as an aqueous preparation, it is preferred that the water content does not exceed 25% by weight, more preferably not exceeding 10% by weight.

Suitable acid precursors include:

- linear alkyl benzene sulphonic acids (LAS acids) which give linear alkyl benzene sulphonates (LAS) upon neutralisation. Preferably, any LAS anionic surfactant has a chain length of $C_{8-18}$, more preferably $C_{9-15}$ and most preferably $C_{10-14}$.
- alkyl and/or alkenyl sulphuric acid half-esters (i.e. the sulphation products of primary alcohols) which give alkyl and/or alkenyl sulphates upon neutralisation. The present invention has especial applicability in the production of detergent particles comprising PAS having a chain length of $C_{10-22}$, preferably $C_{12-14}$; Coco PAS is particularly desirable.
- carboxylic acids which give soaps upon neutralisation. Preferred carboxylic acids are fatty acids with 12–18 carbon atoms, such as for example fatty acids of coconut oil, palm oil, palm kernel and tallow.

Other suitable acid precursors include alphaolefin sulphonic acids, internal olefin sulphonic acids, fatty acid ester sulphonic acids and primary sulphonic acids.

It is also possible to use combinations of various acid precursors as will be apparent to the skilled person.

Neutralising Agent

The neutralising agent is a particulate base material capable of neutralising the acid precursor. In principle, any alkaline inorganic material can be used for the neutralisation but water-soluble alkaline inorganic materials are preferred. Preferably also, it has a D50 particle size less than 40 μm, preferably less than 20 μm, especially less than 10 μm. D50 refers to the value of particle size corresponding to 50% weight percent of the particles on a size distribution curve (i.e. half of the area under the curve is to the right of this value, and half to the left).

Suitable neutralising agents include any salts of hydroxides, carbonates, bicarbonates and silicates. Suitably, the sodium, potassium, calcium or magnesium salts may be used. However, the sodium salt is preferred.

A preferred neutralising agent is sodium carbonate alone or in combination with one or more other water-soluble inorganic materials, for example, sodium bicarbonate or silicate.

Resultant Detergent Particles

In addition to the acid precursor and neutralising agent, other liquid and solid components may be fed to the drying region of the evaporator/drier, and/or the cooling zone if present. For example, pre-neutralised surfactants, e.g. PAS, LAS and LES may be fed into the drying region as separate streams and/or as an admixture with the neutralising agent and/or acid precursor.

However, it is desirable that the weight ratio of the total liquid ingredients to the total solid ingredients fed to the drying region of the evaporator/drier, or, where a cooling zone is employed, to the drying zone and cooling zone, is in the range 2:1 to 6:1, preferably from 3:1 to 5:1.

The detergent particles have an anionic surfactant content of at least 40% by weight. The present process can be used to make detergent particles with a anionic surfactant content of at least 50%, 60% or 70% by weight. The maximum amount is typically 90%, preferably 85% by weight.

It is desirable that the particles also comprise water in an amount of 0 to 8% and preferably 0 to 4% by weight of the particles.

Other non-surfactant components which may be present in the detergent particles include dispersion aids, preferably polymeric dispersion aids and more preferably urea, sugars, polyaklyleneoxides; and builders as hereinafter described.

If desired the detergent particles may comprise an organic and/or inorganic salt, e.g. a hydratable salt. Suitable materials in salts, preferably sodium, of tripolyphosphate, citrates, carbonates, sulphates, chlorides. Aluminosilicates, clays, silicas and other inorganic materials may also be included.

The particles may also contain one or more nonionic surfactants, for example as mentioned below in the context of a base powder with which the particles are admixed.

Similarly, organic materials, e.g. PEG and other polymer builder or soap may also be included in the particles, also as mentioned below in the latter context.

Desirably the detergent particles have an aspect ratio not in excess of 2 and more preferably are generally spherical in order to reduce segregation from other particles in a formulated detergent composition and to enhance the visual appearance of the powder.

The Aluminosilicate

The aluminosilicate may suitably be added in a total amount of from 10 to 60 wt % and preferably an amount of from 15 to 50 wt % of the resultant detergent particles, provided that if all of the aluminosilicate is dosed in the cooling region, it is in an amount at least 20%, preferably at least 25% and more preferably at least 30%, by weight of the particles. It is envisaged that all of the aluminosilicate may be fed between the drying and the cooling region and it is preferred that at least 50%, more preferably at least 80% by weight of the aluminosilicate will be fed between the drying and the cooling region. The aluminosilicate used in most commercial particulate detergent compositions is zeolite A. Advantageously, however, maximum aluminium zeolite P (zeolite MAP) described and claimed in EP-A-384 070 may be used. Zeolite MAP is an alkali metal aluminosilicate of the P type having a silicon to aluminium ratio not exceeding 1.33, preferably not exceeding 1.15, and more preferably not exceeding 1.07.

Detergent Compositions

The detergent particles may be post-dosed directly to a base powder obtained from any conventional detergent production process including a non tower process in which the components of the detergent composition are mixed and granulated as described e.g. in EP-A-367 339 and a spray drying process optionally followed by a post tower densification. As the detergent particles produced by the present invention may be post-dosed to such powders a significant degree of formulation flexibility is obtained and the level of active material in the fully formulated composition may be very high as desired. A further advantage is that a base powder which is substantially free of detergent active compounds may be produced as the detergent active compounds may be introduced substantially wholly as post-dosed particles.

The option of reducing the level of detergent active material in a base powder is especially advantageous where the base powder is produced by a spray drying process as a lower level of detergent active compound in the spray drying process permits a higher finished product output to be secured thus increasing overall production efficiency.

Compositions according to the present invention may also contain, in addition to the detergent-active compound, a detergency builder and optionally bleaching components and other active ingredients to enhance performance and properties.

Detergent compositions of the invention may contain, in addition to the post-dosed detergent particles, one or more detergent-active compounds (surfactants) which may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of C8–C15; primary and secondary alkyl sulphates, particularly C12–C15 primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The total amount of surfactant present in the detergent composition is suitably from to 5 to 40 wt % although amounts outside this range may be employed as desired.

The detergent compositions of the invention generally also contain a detergency builder. The total amount of detergency builder in the compositions is suitably from 10 to 80 wt %, preferably from 15 to 60 wt %. The builder may be present in an adjunct with other components or, if desired, separate builder particles containing one or more builder materials may be employed.

Inorganic builders that may be present include sodium carbonate, if desired in combination with a crystallisation seed for calcium carbonate, as disclosed in GB-A-1 437 950; crystalline and amorphous aluminosilicates, for example zeolites as disclosed in GB-A-1 473 201; amorphous aluminosilicates as disclosed in GB-A-1 473 202; and mixed crystalline/amorphous aluminosilicates as disclosed in GB 1 470 250; and layered silicates as disclosed in EP-B-164 514. Inorganic phosphate builders, for example, sodium, orthophosphate, pyrophosphate and tripolyphosphate, may also be present, but on environmental grounds those are no longer preferred.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. A copolymer of maleic acid, acrylic acid and vinyl acetate is especially preferred as it is biodegradable and thus environmentally desirable. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. The builder is preferably present in alkali metal salt, especially sodium salt, form.

Suitably the builder system comprises a crystalline layered silicate, for example, SKS-6 ex Hoechst, a zeolite, for example, zeolite A and optionally an alkali metal citrate.

Detergent compositions according to the invention may also contain a bleach system, desirably a peroxy bleach compound, for example, an inorganic persalt or organic peroxyacid, capable of yielding hydrogen peroxide in aqueous solution. The peroxy bleach compound may be used in conjunction with a bleach activator (bleach precursor) to improve bleaching action at low wash temperatures. An especially preferred bleach system comprises a peroxy bleach compound (preferably sodium percarbonate optionally together with a bleach activator), and a transition metal bleach catalyst as described and claimed in EP 458 397A and EP-A-509 787.

The compositions of the invention may contain alkali metal, preferably sodium, carbonate, in order to increase detergency and ease processing. Sodium carbonate may suitably be present in an amount from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate polymer, or sodium silicate which is suitably present in an amount of from 1 to 5 wt %.

The materials that may be present in detergent compositions of the invention include sodium silicate; corrosion inhibitors including silicates; antiredeposition agents such as cellulosic polymers; fluorescers; inorganic salts such as sodium sulphate, lather control agents or lather boosters as appropriate; proteolytic and lipolytic enzymes; dyes; coloured speckles; perfumes; foam controllers; and fabric softening compounds. This list is not intended to be exhaustive.

The base composition is suitably prepared by spray-drying a slurry of compatible heat-insensitive ingredients, and then spraying on, admixing and/or postdosing those ingredients unsuitable for processing via the slurry. The detergent particles produced according to the process of the present invention are post-dosed to the base composition by conventional methods.

Detergent compositions of the invention preferably have a bulk density of at least 400 g/l, e.g. at least 500 g/l, more preferably at least 550 g/liter.

Such powders may be prepared either by spray-drying, by post-tower densification of spray-dried powder, or by wholly non-tower methods such as dry mixing and granulation. A high-speed mixer/granulator may advantageously be used for such mixing. Processes using high-speed mixer/granulators are disclosed, for example, in EP-A-340 013, EP-A-367 339, EP-A-390 251 and EP-A-420 317.

The invention is illustrated by the following non-limiting Examples.

EXAMPLES

Examples 1–4

A trial was carried out using a VRV Flash Drier, granulating sodium alkyl benzene in sulphonate (NaLAS) formed by neutralisation of LAS and with sodium carbonate in amounts such that with 5% water, unreacted carbonate and impurities, the zeolite being as shown in brackets, then the balance by weight is Na LAS. These amounts are on the basis of the granules so produced. The position of the zeolite addition was varied. Table 1 below shows the effect that this had on particle size. In this Table, jacket 1 refers to the first heating jacket, jacket 2 refers to the second heating jacket and jacket 3 refers to the single cooling jacket. These therefore correspond to heating and cooling zones as appropriate. Example A is a control not in accordance with the invention.

TABLE 1

Particle size and as a function of the position of zeolite addition

| Example | Zeolite 4A 1st Dose | Zeolite 4A 2nd Dose | >1400 microns | Mean size D50 |
|---|---|---|---|---|
| A | In 3rd jack. (19%) | None | 20.1 | 1185 |
| 1 | Before 1st jack. (20%) | Between 2/3 jack. (5%) | 14.4 | 930 |
| 2 | In 1st jacket (20%) | Between 2/3 jack. (5%) | 5.7 | 649 |
| 3 | Between 2/3 jack. (25%) | None | 5.1 | 474 |
| 4 | Between 2/3 jack. (35%) | None | 0.5 | 314 |

The above data in Table 1 shows that there is a very large decrease in both particle size when 20% or more of the zeolite is added at the end of the process.

What is claimed is:

1. A process for the production of detergent particles, the process comprising feeding an acid precursor of an anionic surfactant, a neutralising agent and aluminosilicate detergency builder into a horizontal thin-film evaporator/drier comprising a mixing region, a drying region and a cooling region, to effect neutralisation of the acid precursor, granulation, drying and cooling, to form the said detergent particles, wherein at least some of the aluminosilicate builder is fed into the thin-film evaporator/drier between the drying region and the cooling region and/or into the cooling region, provided that when all of the aluminosilicate builder is fed into the cooling region, the aluminosilicate is in an amount of more than 20% by weight of the particles exiting the cooling region.

2. A process for the production of detergent particles, the process comprising feeding an acid precursor of an anionic surfactant, a neutralising agent and aluminosilicate detergency builder into a horizontal thin-film evaporator/drier comprising a mixing region, a drying region and a cooling region, to effect neutralisation of the acid precursor, granulation, drying and cooling, to form the said detergent particles, wherein at least some of the aluminosilicate builder is fed into the thin-film evaporator/drier between the drying region and the cooling region and/or into the cooling region, provided that when all of the aluminosilicate builder is fed into the cooling region, the aluminosilicate is in an amount of more than 25% by weight of the particles exiting the cooling region.

3. A process for the production of detergent particles, the process comprising feeding an acid precursor of an anionic surfactant, a neutralising agent and aluminosilicate detergency builder into a horizontal thin-film evaporator/drier comprising a mixing region, a drying region and a cooling region, to effect neutralisation of the acid precursor, granulation, drying and cooling, to form the said detergent particles, wherein at least some of the aluminosilicate builder is fed into the thin-film evaporator/drier between the drying region and the cooling region and/or into the cooling region, provided that when all of the aluminosilicate builder is fed into the cooling region, the aluminosilicate is in an amount of more than 30% by weight of the particles exiting the cooling region.

4. A process according to claim 1, wherein at least some of the aluminosilicate is fed between the drying region and the cooling region.

5. A process according to claim 4, wherein at least 50% of the aluminosilicate is fed between the drying region and the cooling region.

6. A process according to claim 4, wherein at least 80% of the aluminosilicate is fed between the drying region and the cooling region.

7. A process according to claim 4, wherein all of the aluminosilicate is fed between the drying region and the cooling region.

8. A process according to claim 4, wherein the total amount of aluminosilicate fed in the evaporator/drier is from 10% to 60%, preferably 15% to 50% by weight of the detergent particles.

9. A process according to claim 1, wherein the neutralising agent is fed into the mixing region in at least stoichiometric equality to the amount required for neutralisation of the acid precursor.

10. A process according to claim 9, wherein the amount of neutralising agent is from 1.25 to 2 times the amount required for stoichiometric neutralisation.

11. A process according to claim 9, wherein the neutralising agent is fed into the mixing region in stoichiometric excess to the amount required for neutralisation of the acid precursor.

* * * * *